US006769794B2

(12) United States Patent
Huang

(10) Patent No.: US 6,769,794 B2
(45) Date of Patent: Aug. 3, 2004

(54) DECORATIVE GARDEN LAMP

(76) Inventor: Ming-Hsien Huang, No. 2, Lane 65, Cheng Kong Road, Hsinchu (TW)

( * ) Notice: Subject to any disclaimer, the term of this patent is extended or adjusted under 35 U.S.C. 154(b) by 0 days.

(21) Appl. No.: 10/227,851

(22) Filed: Aug. 27, 2002

(65) Prior Publication Data

US 2004/0042216 A1 Mar. 4, 2004

(51) Int. Cl.[7] ..... F21V 15/02

(52) U.S. Cl. ..... 362/363; 362/352; 362/806; 362/278; 362/377

(58) Field of Search ..... 362/437, 375, 362/351, 352, 806, 278, 320, 376–378, 363, 431, 186, 189, 162, 173, 450

(56) References Cited

U.S. PATENT DOCUMENTS 5,083,250 A * 1/1992 Malcolm ..... 362/253
6,305,827 B1 * 10/2001 Nolle ..... 362/352

* cited by examiner

*Primary Examiner*—Alan Cariaso
*Assistant Examiner*—Guiyoung Lee
(74) *Attorney, Agent, or Firm*—Rosenberg, Klein & Lee

(57) ABSTRACT

The present invention relates to a decorative garden lamp, which includes a holding rod connecting with a bulb holder and a bulb, wherein a soft cover is provided around the bulb and the bulb holder. The characteristic of the invention is that a shell is provided in the soft cover around the bulb to avoid the soft cover contacting with the bulb directly when air leakage is happened. So the soft cover is avoided from being burned.

1 Claim, 3 Drawing Sheets

DECORATIVE GARDEN LAMP

BACKGROUND OF THE INVENTION

A conventional decorative garden lamp mainly includes a holding rod to connect with a bulb assembly, which is provided with a patterned cover for various decorative effects. The prior cover is a rigid body and is monotonous. It is known that an improvement is designed to use a soft cover, which to show a different outlook. But the known soft cover being fulfilled by air may be broken and the air will be leaked out. At this time, the soft cover contacts with the bulb directly that may cause danger of fire.

Accordingly, the primary object of the invention is to provide a decorative garden lamp, which provides a shell outside the bulb for avoiding the soft cover to contact with the bulb directly when it happens a leakage of air. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
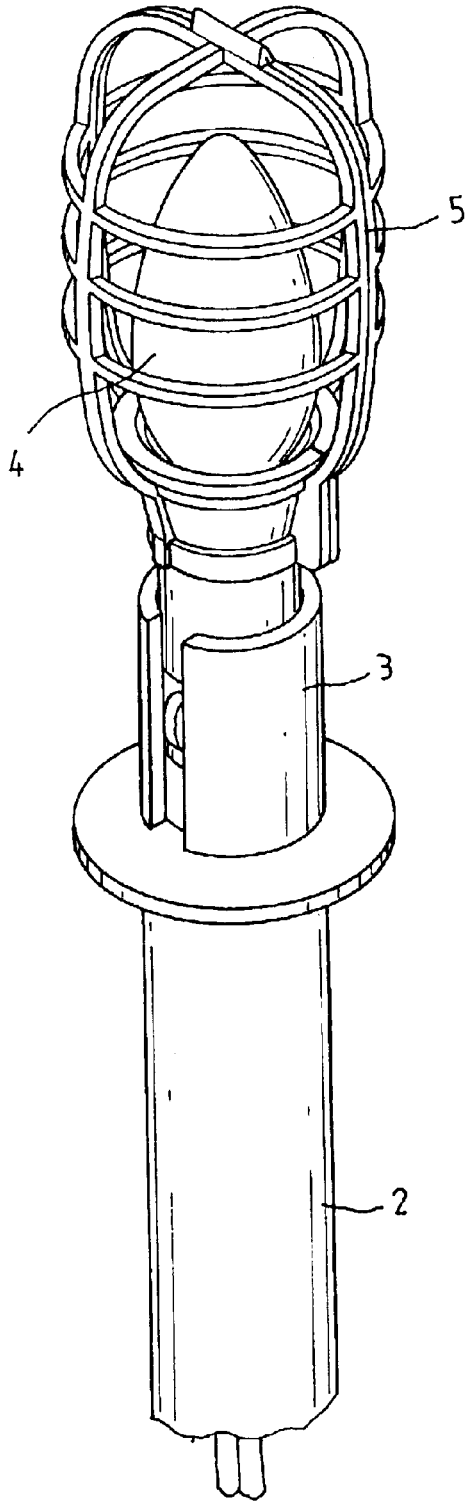
FIG. 1 is a perspective view showing a decorative garden lamp according to the present invention.
Figure 2:
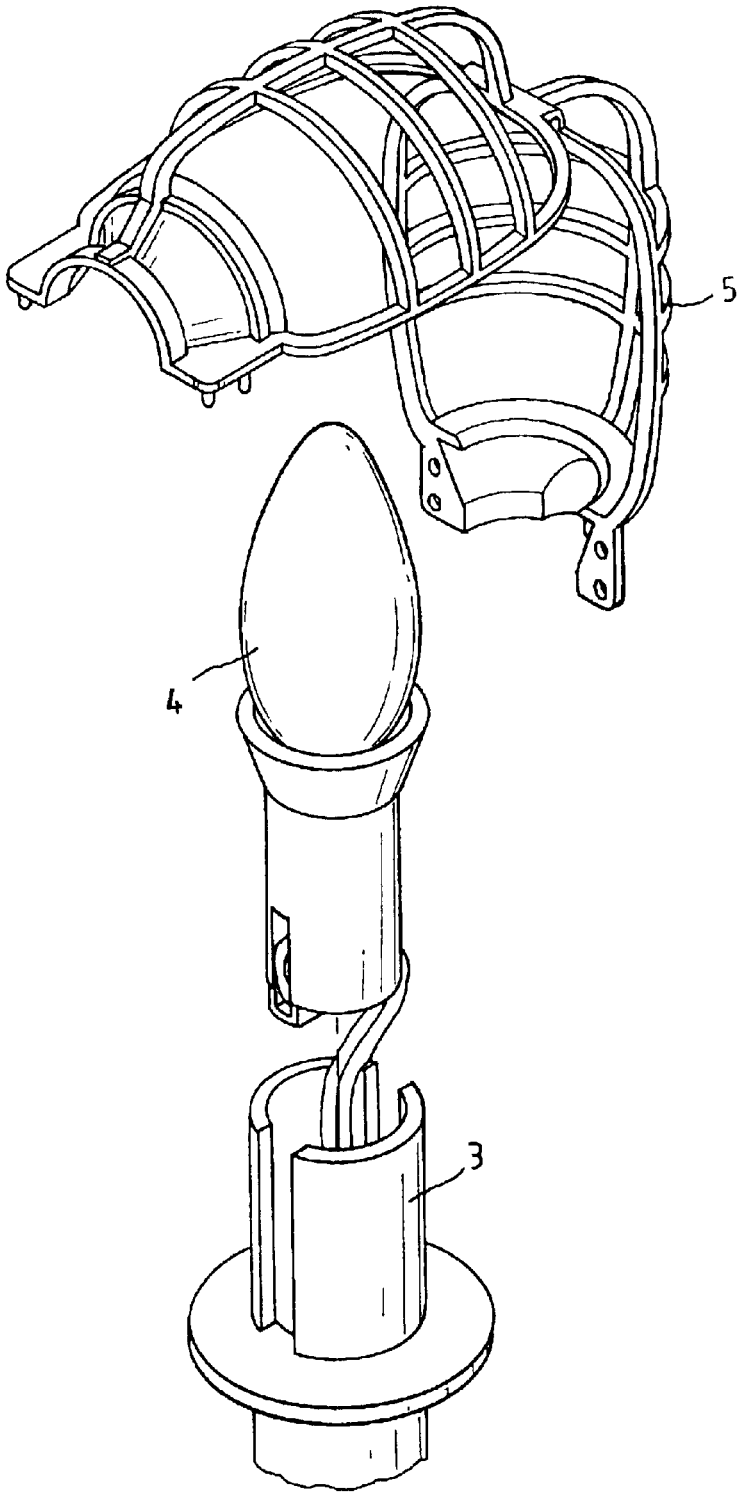
FIG. 2 is an exploded perspective view of FIG. 1.
Figure 3:
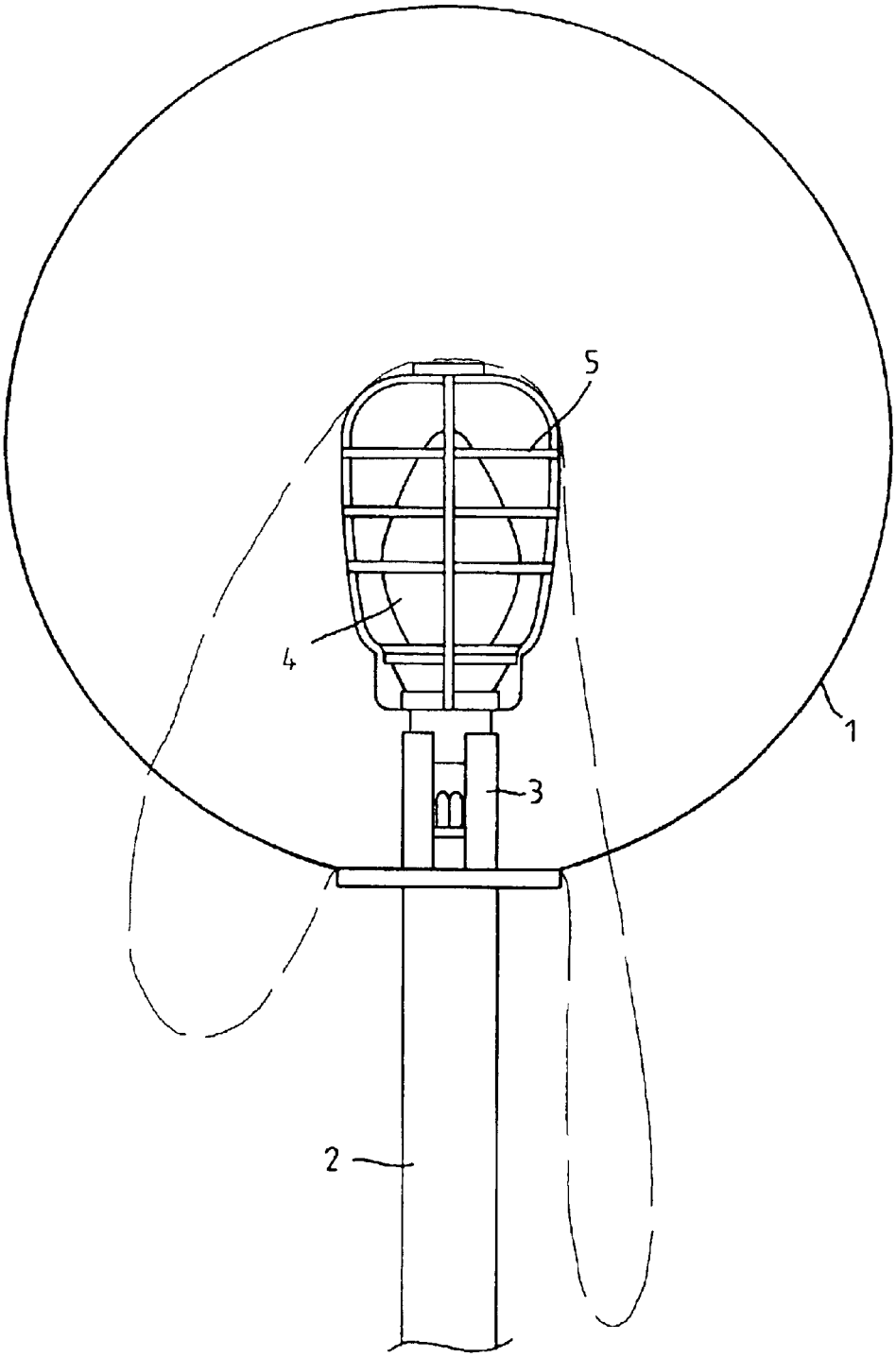
FIG. 3 is a plan view showing the decorative garden lamp with a soft cover.

Please refer to FIGS. 1 to 3, the present invention includes a holding rod (2), a bulb holder (3), and a bulb (4). A soft cover (1) is provided around the bulb (4) and the bulb holder (3). The characteristic of the present invention is to provide a shell (5) around the bulb (4) for separation from the soft cover (1).

If the soft cover (1) is shrunk (FIG. 3) due to any factor, it contacts with the shell (5) only. Because of this separation, the soft cover (1) is avoided from being burned that obtains a safe effect of the decorative garden lamp.

Accordingly, the present invention uses the invented shell around the bulb of the decorative garden lamp to separate the soft cover from the bulb when an air leakage happens in accident. Hence, it obviously achieves utility and improvement and should be allowed for patent.

What is claimed is:

1. A decorative garden lamp comprising:

a holding rod;

a bulb holder disposed at one end of said holding rod;

a bulb disposed in said bulb holder and having upper and lower portions;

an inflatable and soft cover coupled to said bulb holder and encompassing said bulb; and, a shell having a lower section coupled to said lower portion of said bulb and an upper section surrounding said upper portion of said bulb, said upper section being spaced from an outer surface of said upper portion of said bulb and an inner surface of said cover, said upper section being formed by an open gridwork, said shell being formed by a pair of half shell members hingedly joined together, wherein said shell prevents said cover in a deflated condition from contacting said bulb.

* * * * *